US006102455A

United States Patent [19]

Schurman

[11] Patent Number: 6,102,455

[45] Date of Patent: Aug. 15, 2000

[54] LATCH STRUCTURE

[75] Inventor: Peter T. Schurman, Woodbridge, Conn.

[73] Assignee: The Plastic Forming Company, Inc., Woodbridge, Conn.

[21] Appl. No.: 08/903,461

[22] Filed: Jul. 30, 1997

[51] Int. Cl.[7] ..... E05C 19/10

[52] U.S. Cl. ..... 292/249; 292/DIG. 38

[58] Field of Search ..... 292/65, 67, 80, 292/87, 89, 101, 102, 106, 107, 109, 110, 114, 203, 204, 303, 304, DIG. 38, DIG. 53, 246–250; 24/573.1; 220/324; 190/119, 123, 154 R

[56] References Cited

U.S. PATENT DOCUMENTS

| | | | |
|---|---|---|---|
| 2,872,066 | 2/1959 | Piker | 220/324 |
| 3,584,906 | 6/1971 | Budzyn | 70/73 |
| 3,730,576 | 5/1973 | Schurman . | |
| 3,977,595 | 8/1976 | Hillgenberg | 292/87 |
| 4,008,584 | 2/1977 | Wingert | 70/73 |
| 4,023,840 | 5/1977 | Souza | 292/113 |
| 4,074,549 | 2/1978 | Yee | 70/7 |
| 4,244,612 | 1/1981 | Schurman | 292/249 |
| 4,522,312 | 6/1985 | Rathgeber | 292/249 |
| 4,643,281 | 2/1987 | Erickson | 190/119 |
| 4,705,308 | 11/1987 | Bisbing | 292/109 |
| 4,818,502 | 4/1989 | Taschner | 292/204 |
| 5,442,840 | 8/1995 | Ewald | 24/573.1 |
| 5,659,931 | 8/1997 | Anscher | 24/573.1 |

*Primary Examiner*—B. Dayoan
*Assistant Examiner*—Gary Estremsky
*Attorney, Agent, or Firm*—Bachman & LaPointe, P.C.

[57] ABSTRACT

A latch structure for a container having mating first and second portions and an improved container assembly, wherein said latch structure has improved strength characteristics. The side legs of the generally rectangular latch are canted so that the outer surface thereof falls away from the inner surface thereof.

24 Claims, 4 Drawing Sheets

LATCH STRUCTURE

BACKGROUND OF THE INVENTION

The present invention relates generally to the container art, and more particularly to plastic containers and plastic latches and to a new and improved latch structure for securing two portions of a container together.

Generally, the two portions of the container are hinged together along one side thereof, and the opposite side is provided with one or more latches for securing the two sides together. The latches are preferably separately molded from the container portions and fixedly secured thereto as an integral part thereof.

Impact resistance represents an important property. For example, if a case is dropped especially with a heavy material therein, the case tends to pop open and break the latch, particularly if the latch has low impact resistance. However, a latch with good impact resistance would tend to remain secure and counteract the tendency for the case to pop open.

U.S. Pat. Nos. 3,730,576 and 4,244,612 show representative prior art latch structures.

It is desirable to provide an improved latch structure which provides improved impact resistance, and this is a principal objective of the present invention.

It is a further objective of the present invention to provide a latch structure with good appearance and with other desirable properties.

Further objects and advantages of the present invention will appear hereinbelow.

SUMMARY OF THE INVENTION

In accordance with the present invention, the foregoing objectives are readily obtained.

The present invention provides an improved latch member for a container having mating first and second portions as a body portion and a cover portion, and an improved container assembly. The latch of the present invention includes a one-piece, unitary latch member mounted on one of the container portions and having opposed mounting and latching bar portions and a pair of side leg portions extending between and interconnecting the mounting and latching bar portions to provide a latching member of generally rectangular configuration, wherein the bar portions and side portions form a central opening.

The latch member includes means on the mounting bar for interlocking engagement with a first of said container portions, and a locking tab extending from said latching bar for snap-fitted, releasable interlocking engagement with one of said container portions.

In addition, the side leg portions have outer surface portions spaced from the central opening and inner surface portions adjacent said central opening, wherein said side leg portions are canted so that said outer surface portions fall away from said inner surface portions in a direction towards said container and subtend acute angles with respect to said inner surface. In addition, the latch member has an outside face and an inside face, wherein the outer surface portions fall away from the inner surface portions in a direction towards the inside face.

It has been found that the latch structure of the present invention has improved performance over prior latch structures and especially provides improved impact resistance as well as improved appearance.

Further advantages and features of the present invention will appear hereinbelow.

BRIEF DESCRIPTION OF THE DRAWINGS

The present invention will be more readily understandable from a consideration of the illustrative drawings, wherein.

DETAILED DESCRIPTION OF PREFERRED EMBODIMENTS

Figure 1:
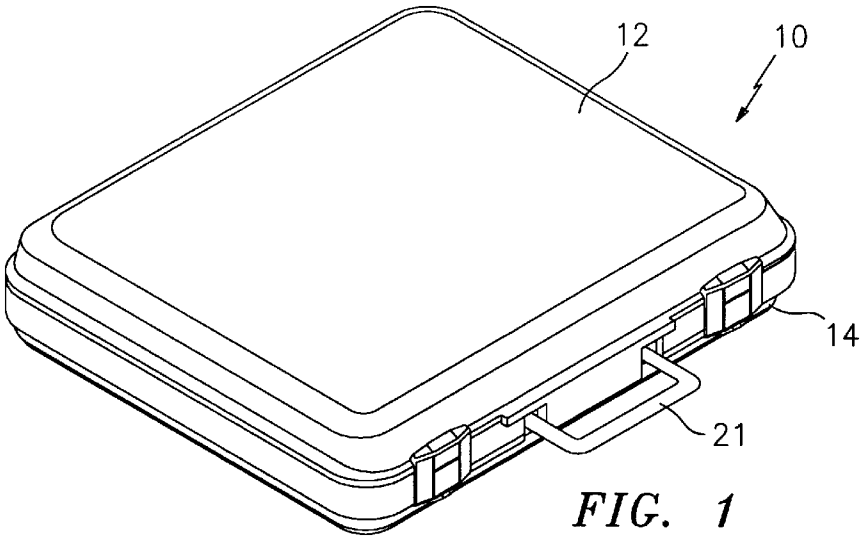
FIG. 1 is a perspective view of a closed container with latches of the present invention.
Figure 2:
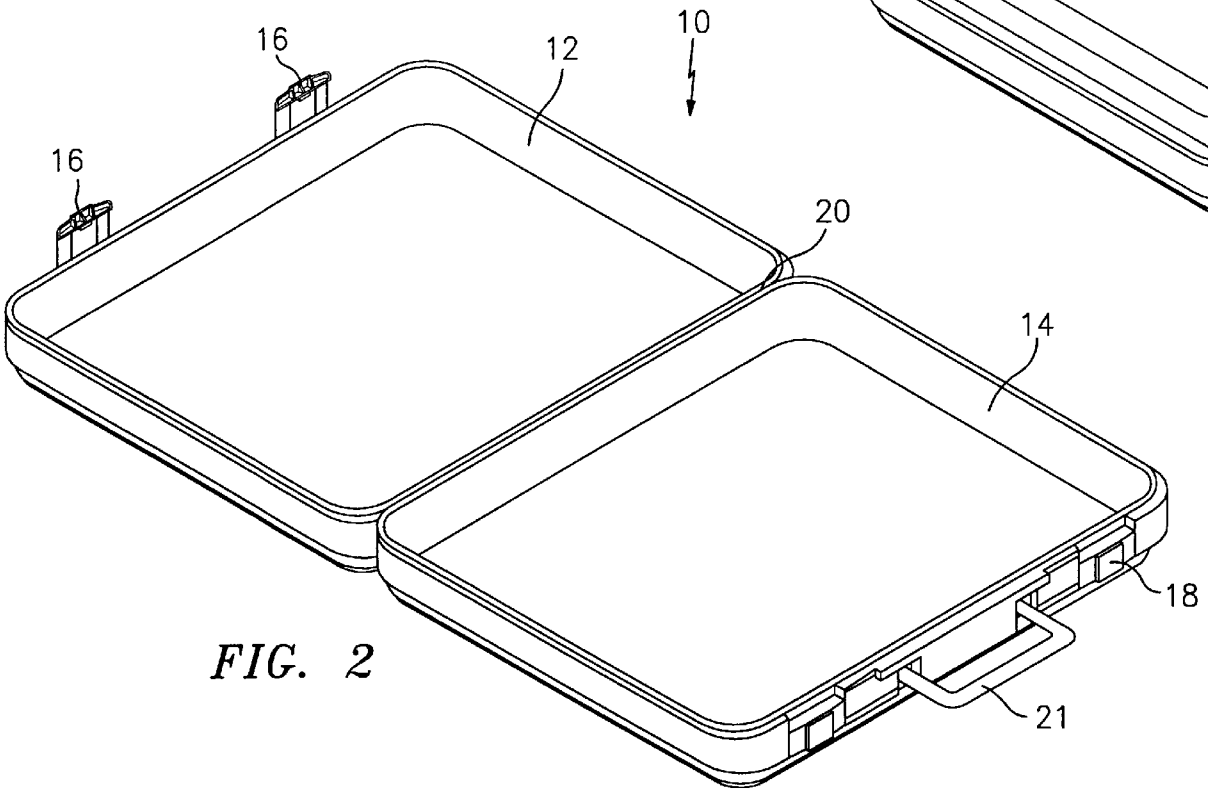
FIG. 2 is a perspective view of the container of FIG. 1 in the open condition.

FIGS. 1 and 2 show a representative container 10 in the closed (FIG. 1) position and in the open (FIG. 2) position. Container 10 has mating first 12 and second 14 portions, with the second portion 14 being the base or body portion and the first portion 12 being the cover portion. In this embodiment, container 10 includes two (2) latch members 16 for releasably locking first or cover portion 12 to base or second portion 14. In order to detachably secure latches 16, the latch members are secured to first portion 12 and the second portion 14 is provided with a pair of latch receiving extensions 18 formed integral with second portion 14. The first 12 and second 14 portions are hingedly connected together at hinge portion 20. Container 10 is preferably provided with a handle 21 on at least one of the cover and base portions.

Naturally, the shape and configuration of container 10 may vary, for example, the container may be square, oblong or rectangular, or have any desired and convenient shape, generally depending on the material or materials to be contained therein.

The first 12 and second 14 portions are preferably made of plastic material, as thermoplastic, for example, polyethylene or polypropylene, and blow molded into a hollow, double wall construction, preferably with recesses therein for holding desired shaped objects. Handle 21 is generally pivotally mounted thereon, although the particular handle configuration may naturally vary.

Figure 3:
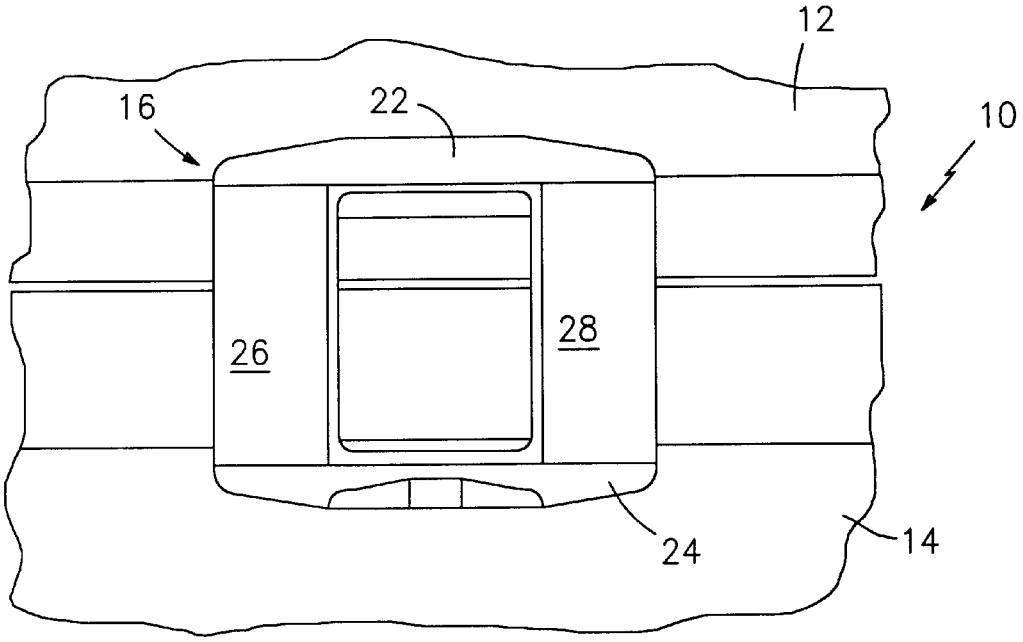
FIG. 3 is a fragmentary front elevational view of a latch of the present invention on an enlarged scale in the closed position.

FIG. 3 shows latch 16 affixed to first or cover portion 12 with container 10 in the closed position. The latch 16 is a one-piece unitary structure having mounting 22 and latching 24 bar portions and a pair of side leg portions 26, 28. The side leg portions 26, 28 extend between and interconnect the mounting 22 and latching 24 bar portions to provide a latching member of generally rectangular configuration. The bar portions 22, 24 and side portions 26, 28 form a central opening 30, clearly seen in FIG. 9.

Figure 9:
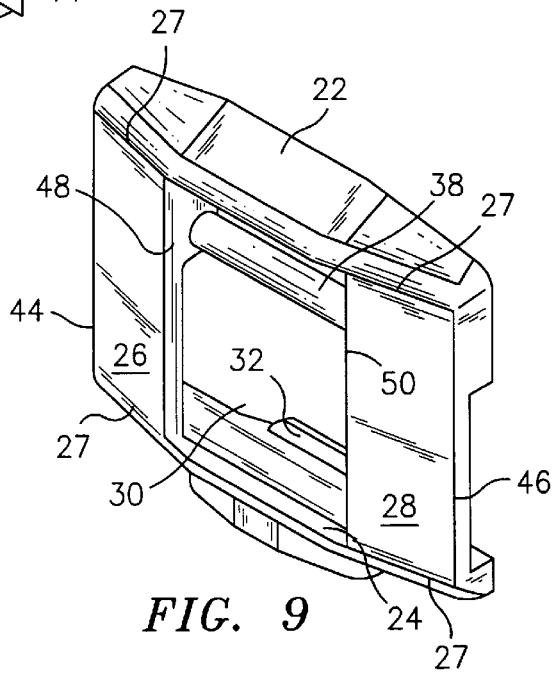
FIG. 9 is a perspective view of the latch of FIG. 6.
Figure 10:
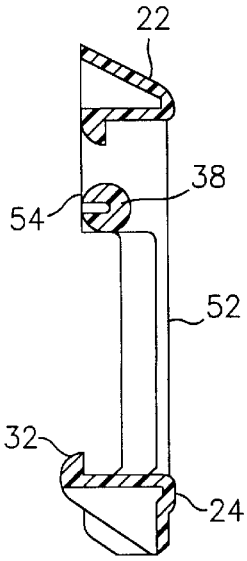
FIG. 10 is a sectional view along line 10—10 of FIG. 6.

Latch member 16 has an outside face 52 and an inside face 54, as shown in FIG. 10. Referring to FIG. 9, latch member 16 includes a locking tab 32 extending inwardly from latching bar 24 and towards mounting bar 22 for snap-fitted, releasable interlocking engagement with latch receiving extensions 18 on container 10 as clearly shown in FIG. 5.

It can be readily seen that latch member 16 is subject to repeated impact during use which results in damage and shortened life. This is highly disadvantageous and it is desirable to improve the latch member so as to minimize this problem, while retaining desirable properties and appearance thereof and also permitting easy molding, assembly and use.

Figure 5:
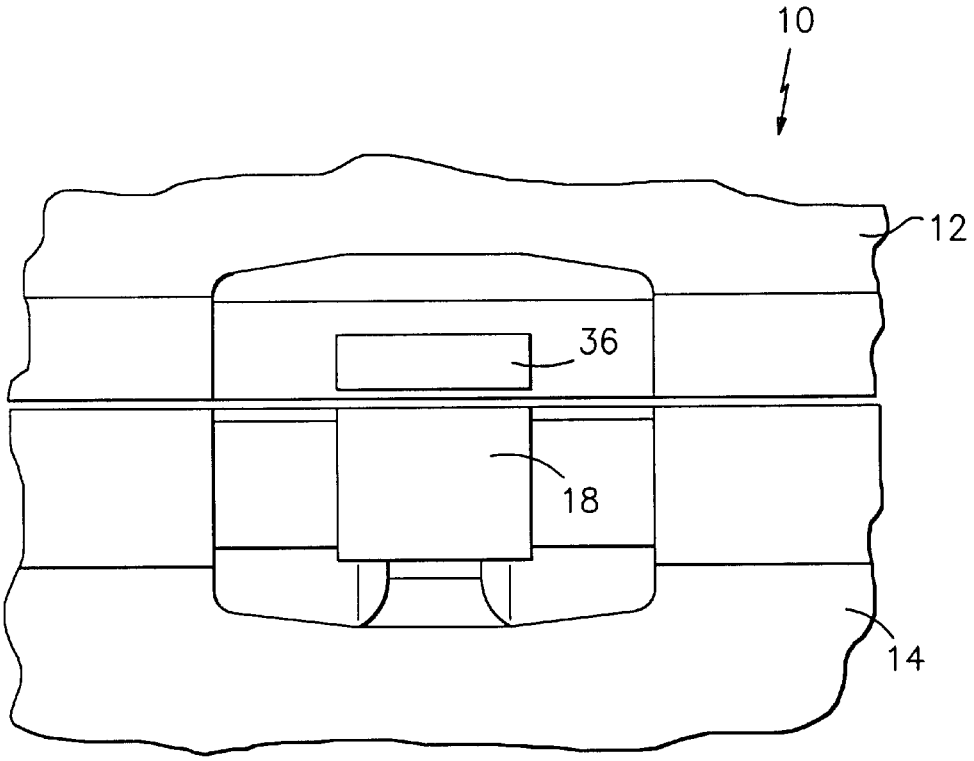
FIG. 5 is a fragmentary front elevational view of a container without the latch attached.
Figure 4:
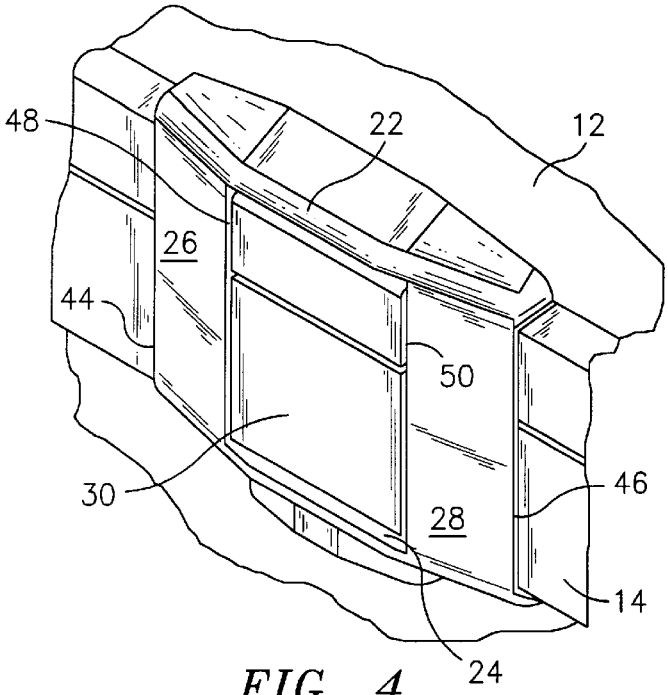
FIG. 4 is a perspective view of the latch of FIG. 3.

Latch member 16 also includes anchor bar 34 extending downwardly from mounting bar portion 22 for mounting latch 16 on container 10 on anchor member 36 shown in FIG. 5. Latch 16 is molded separately from the container and mounted on container 10. Latch 16 may also include cross member 38 extending from side leg portion 26 to side leg portion 28 across central opening 30 dividing opening 30 into upper smaller portion 40 adjacent anchor bar 34 and larger lower portion 42 adjacent locking tab 32.

Figure 11:
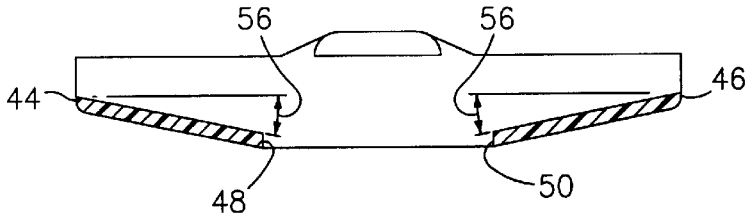
FIG. 11 is a sectional view along line 11—11 of FIG. 6.
Figure 7:
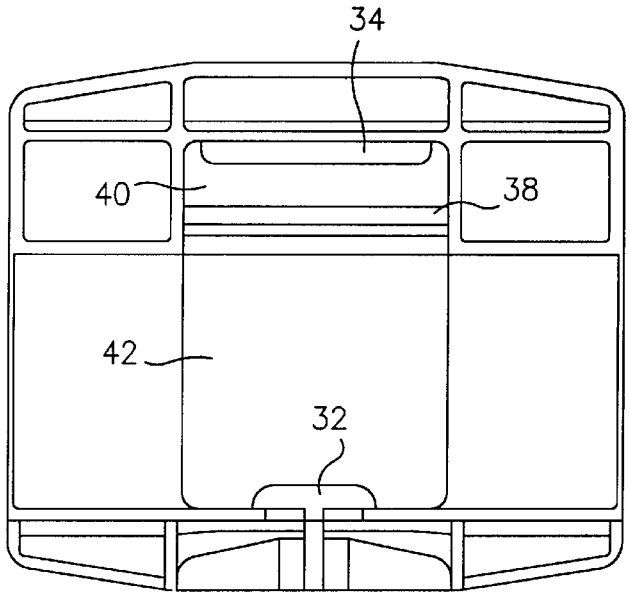
FIG. 7 is a rear elevational view of the latch of FIG. 6.
Figure 8:
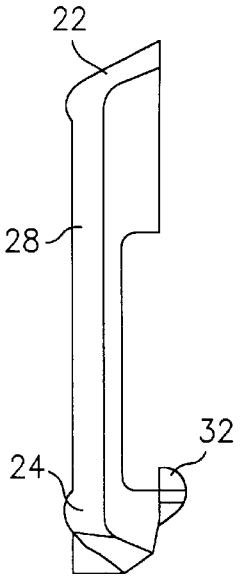
FIG. 8 is a side view of the latch of FIG. 6.
Figure 6:
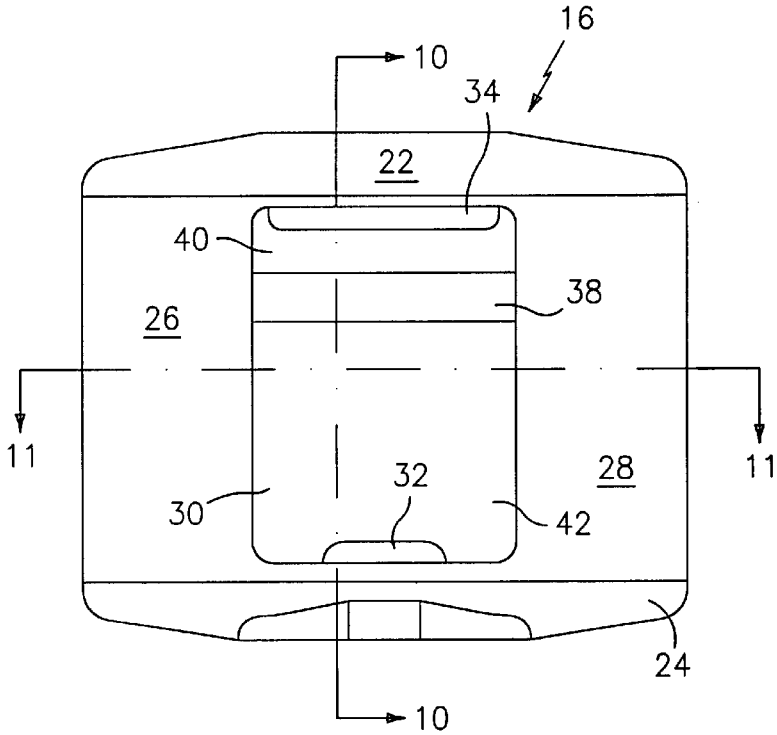
FIG. 6 is a front elevational view of a latch of the present invention unattached to a container.

In accordance with the present invention, each side leg portion 26, 28 has an outer surface portion 44, 46, respectively, spaced from the central opening 30 and an inner surface portion 48, 50, respectively, on or adjacent the central opening 30. The side leg portions 26, 28 are canted so that the outer surfaces 44, 46 fall away from the inner surfaces 48, 50 in a direction towards container 10 and subtend acute angles 56 with respect to the said inner surfaces as clearly shown in FIG. 11, preferably angles of from 5 to 20° and optimally 10 to 15°. In addition, side leg portions 26, 28 have a substantially smooth transition 27 between the side leg portions 26, 28 and bar portions 22, 24.

Thus, the side leg portions are non-parallel and are effectively operating as non-parallel, bending side rails which operate quite effectively. Surprisingly, tests have shown that the present latch has significantly increased impact resistance over conventional latches.

As indicated hereinabove, good impact resistance is an important latch property. It has been found that the latches of the present invention have surprising and unexpectedly high impact resistance when compared to conventional latches having parallel side rails, e.g., on the order of at least 35% higher impact resistance. The impact resistance was tested by securing the latch in a fixture, attaching a weight to the end of a chain with the opposite end attached to the latch and determining the distance the weight can be dropped before the latch shows a break. This test simulates dropping the latched case which tends to want to force open the case and break the latch. The surprising improvement in impact resistance of the latch of the present invention represents a considerable advantage and would not be expected from the configuration of the non-parallel side leg portions of the present invention. Indeed, the novel configuration of the latch of the present invention seems to transmit some of the impact force to other portions of the latch, resulting in improved impact resistance.

In addition, the latch of the present invention has a substantially smooth transition between the side leg portions and bar portions, which is believed to contribute to the surprisingly good impact resistance of the latch of the present invention. On the other hand, the latch with parallel side leg or side rail portions includes a step between the side leg portions and bar portions.

A further disadvantage of latches with parallel side legs is the tendency of the edges to curl away from the front surface of the case when the latch is subject to load, as when the case is overstuffed with contents and the lid is forced shut. This tendency is particularly noticeable and objectionable in larger cases with larger latches. It often necessitates the use of a double latch to avoid this problem, and double latches are less attractive, more expensive, and harder to mold. On the other hand, the outer edges of the latch of the present invention tend to curl toward the front surface of the case when the latch is subject to load. The front edge of the case restricts this movement, and the non-parallel shape of the leg portions of the latch further masks any such movement.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container assembly, which comprises:

mating first and second container portions;

a one-piece, unitary latch member mounted on one of said container portions and having opposed mounting and latching bar portions and a pair of side leg portions extending between and interconnecting the mounting and latching bar portions to provide a latch member of generally rectangular configuration, wherein said bar portions form a central opening;

means on said mounting bar for interlocking engagement with a first of said container portions;

a locking tab extending from said latching bar for snap-fitted, releasable interlocking engagement with a second of said container portions; and wherein said side leg portions have outer surface portions spaced from said central opening and inner surface portions adjacent said central opening and defining said central opening, and wherein said side leg portions are canted so that said outer surface portions are angled away from said inner surface portions in a direction away from said central opening and towards said container when the latch is in the closed position and subtend acute angles with respect to said inner surfaces.

2. A container assembly according to claim 1, wherein said latch member has an outside face and an inside face, and wherein outer surface portions are angled away from said inner surface portions in a direction towards the inside face, and wherein said locking tab is located on the inside face, extending from a central portion of said latching bar.

3. A container assembly according to claim 2, wherein said locking tab extends upwardly from the central portion of said latching bar towards said mounting bar.

4. A container assembly according to claim 1, wherein said outer surface subtends an angle of 5 to 20° with respect to said inner surface.

5. A container assembly according to claim 1, wherein said latch member is plastic.

6. A container assembly according to claim 5, wherein said container is plastic.

7. A container assembly according to claim 1, including a substantially smooth transition between the side leg portions and bar portions.

8. A container assembly according to claim 1, including a handle affixed to at least one of said first and second container portions.

9. A latch member for a container having mating first and second portions, which comprises:

a one-piece, unitary latch member having an inside face and an outside face and mounted on one of said container portions and having opposed mounting and latching bar portions and a pair of side leg portions extending between and interconnecting the mounting and latching bar portions to provide a latching member of generally rectangular configuration, wherein said bar portions form a central opening;

means on said mounting bar for interlocking engagement with a first of said container portions;

a locking tab extending from said latching bar for snap-fitted, releasable interlocking engagement with a second of said container portions; and wherein said side leg portions have outer surface portions spaced from said central opening and inner surface portions adjacent said central opening and defining said central opening, and wherein said side leg portions are canted so that said outer surface portions are angled away from said inner surface portions in a direction away from said central opening and towards said container when the latch is in the closed position and subtend acute angles with respect to said inner surfaces.

10. A latch member according to claim 9, wherein said locking tab is located on the inside face, extending from a central portion of said latching bar.

11. A latch member according to claim 10, wherein said locking tab extends upwardly from the central portion of said latching bar towards said mounting bar.

12. A latch member according to claim 9, wherein said outer surface subtends an angle of 5 to 20° with respect to said inner surface.

13. A latch member according to claim 9, wherein said latch member is plastic.

14. A latch member according to claim 13, wherein said container is plastic.

15. A latch member according to claim 9, including a substantially smooth transition between the side leg portions and bar portions.

16. A latch member according to claim 9, wherein the outer surface portions are angled away from the inner surface portions in a direction towards said container.

17. A container assembly according to claim 1, wherein said mounting bar interconnects said side leg portions, and said latching bar interconnects said side leg portions, to form a continuous circumferential structure.

18. A container assembly according to claim 1, including a cross member extending from one side leg portion to another side leg portion across said central opening.

19. A container assembly according to claim 18, wherein said cross member divides said central opening into a smaller portion and a larger portion.

20. A container assembly according to claim 1, wherein said side leg portions are in non-parallel relationship to each other.

21. A latch member according to claim 9, wherein said mounting bar interconnects said side leg portions, and said latching bar interconnects said side leg portions, to form a continuous circumferential structure.

22. A latch member according to claim 9, including a cross member extending from one side leg portion to another side leg portion across said central opening.

23. A latch member according to claim 22, wherein said cross member divides said central opening into a smaller portion and a larger portion.

24. A latch member according to claim 9, wherein said side leg portions are in non-parallel relationship to each other.

* * * * *